United States Patent [19]

Ridge

[11] Patent Number: 4,671,035

[45] Date of Patent: Jun. 9, 1987

[54] LAMINATE ASSEMBLY AND METHOD

[76] Inventor: Jimmy D. Ridge, Rte. #4, Box 851, High Point, N.C. 27263

[21] Appl. No.: 830,948

[22] Filed: Feb. 19, 1986 (Under 37 CFR 1.47)

[51] Int. Cl.[4] ..... E06B 1/58

[52] U.S. Cl. ..... 52/393; 52/204; 52/631

[58] Field of Search ..... 52/631, 217, 204, 393, 52/795, 798, 799, 800, 406, 210, 211, 212, 213, 214, 397; 285/47; 428/181, 183, 186

[56] References Cited

U.S. PATENT DOCUMENTS

| | | | |
|---|---|---|---|
| 2,330,941 | 10/1943 | Acuff | 52/799 |
| 2,640,794 | 6/1953 | Boysen | 428/186 |
| 2,728,479 | 12/1955 | Wheeler | 52/631 |
| 2,776,231 | 1/1957 | Brown | 52/631 |

FOREIGN PATENT DOCUMENTS

| | | | |
|---|---|---|---|
| 646787 | 8/1962 | Canada | 52/399 |
| 2118046 | 11/1972 | Fed. Rep. of Germany | 52/631 |

*Primary Examiner*—John E. Murtagh

[57] ABSTRACT

A laminate and process for forming the same are demonstrated herein whereby a solid wood lamina is adhered to a corrugated lamina by conventional gluing techniques. The laminate so formed is light in weight and has excellent structural qualities and is useful in manufacturing arcuate and other frames for windows, doors, or other preformed assemblies which are relatively low in cost and which can be produced efficiently.

6 Claims, 7 Drawing Figures

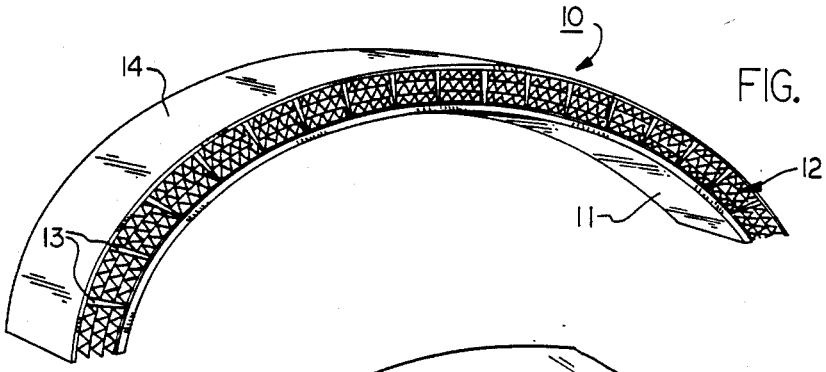
FIG. 1
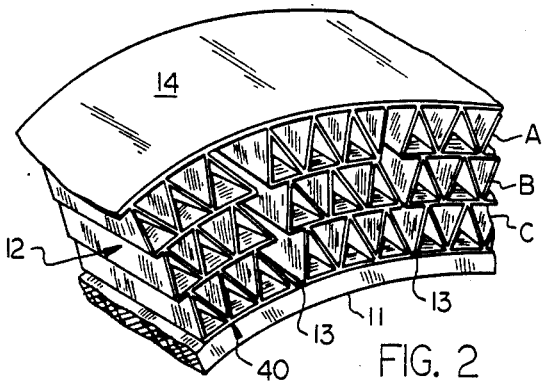
FIG. 2
FIG. 3
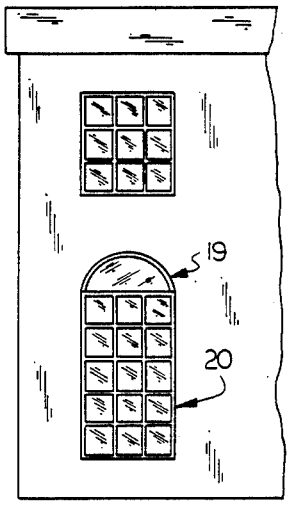
FIG. 4
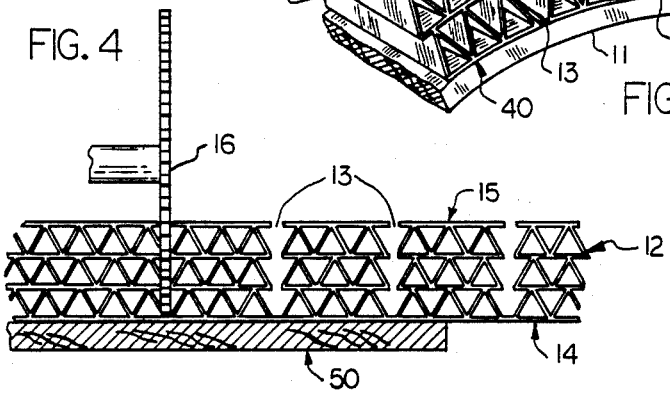
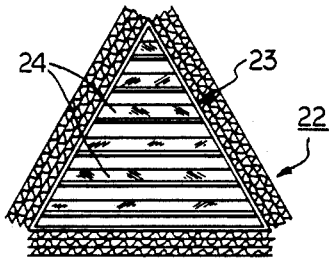
FIG. 6
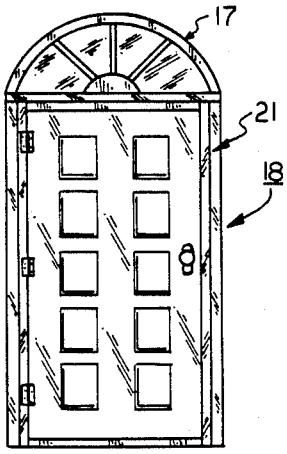
FIG. 7
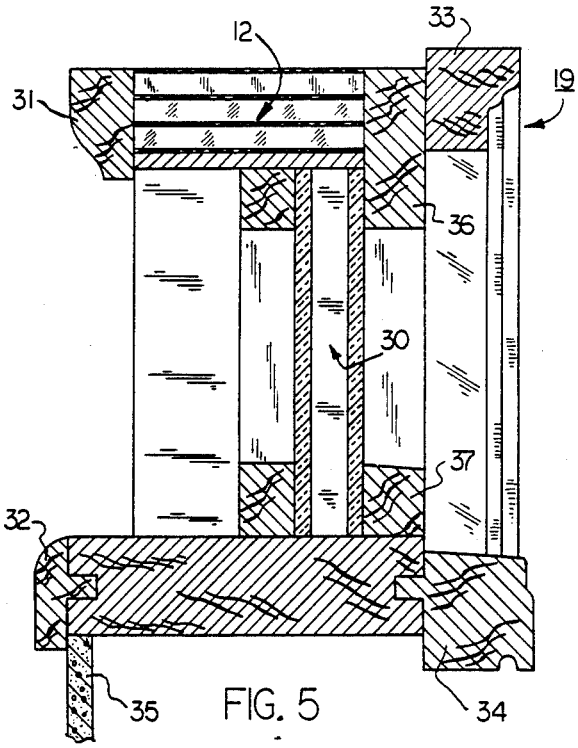
FIG. 5

LAMINATE ASSEMBLY AND METHOD

BACKGROUND OF THE INVENTION

1. Field of the Invention

The invention presented herein relates to preformed doors, windows, louvers and other assemblies used in building construction.

2. Description Of The Prior Art and Objectives of the Invention

Conventional preformed doors, windows, louvers and other assemblies are provided by various manufacturers in the building trade with solid wood frames for insertion by carpenters into "rough" wall openings made as the building is being bricked or framed. The preformed door or other assemblies are then inserted into the rough opening and carpenters then secure and align the assembly and apply moldings or casings once the assembly is properly fitted. Such preformed assemblies generally include a frame made from solid wood which is both heavy for the carpenter to lift and adjust and is relatively expensive. However such conventional framed assemblies have the needed structural integrity required under storage, shipping and installation abuses which they often receive. Thus, with the aforementioned drawbacks and disadvantages of conventional preformed doors, windows, louvers and other assemblies the present invention was conceived and one of its objectives is to provide an assembly which includes an outer frame which has the required structural integrity and capability of conventional solid wood assemblies but is much lighter and is easier to handle.

Another objective of the present invention is to provide a preformed assembly which is durable and which requires less steps in manufacture than employed in conventional solid wood assemblies.

It is also an objective of the present invention to provide an laminate for use in an assembly frame and process for forming the same in which a relatively thin wood member is applied to a corrugated member by conventional gluing techniques.

It is still another objective of the present invention to provide a preformed assembly which is relatively easy to manufacture and is less expensive than conventional assemblies.

Other objectives and advantages of the present invention will become apparent to those skilled in the art as a more detailed description is set forth below.

SUMMARY OF THE INVENTION

A preformed assembly such as a door, window, louver or otherwise for installing into a rough wall opening of a building is shown herein whereby the outer frame of the assembly is formed from a laminate composed of a solid lamina and a corrugated lamina which are bonded together by conventional techniques. Cost and weight advantages are achieved by utilizing the laminate in place of a solid construction employing wood.

The process of the invention demonstrates forming a laminate by shaping a solid lamina such as a wood veneer to a desired configuration such as a half-round shape and then gluing a corrugated lamina having lateral grooves placed therein to the veneer lamina by conventional hot melt gluing techniques. The laminate thus formed maintains the desired half-round configuration which may be used to form preformed windows or doors which, when installed appear identical to solid wood constructions yet which are less expensive, easier to build and are lighter in weight.

BRIEF DESCRIPTION OF THE DRAWINGS

FIG. 1 demonstrates a substantially half-elliptical configuration of the laminate of the invention as would be used in the upper portion of a preformed door or window;

FIG. 2 is an enlarge view of one section of the laminate as shown in FIG. 1;

FIG. 3 demonstrates a preformed window having a half-round upper portion installed in a cutaway view of a house;

FIG. 4 illustrates a corrugated member being sawed to form lateral grooves therein;

FIG. 5 is a detailed side cross-sectional view of a preformed window assembly installed in a building;

FIG. 6 demonstrates a preformed louver assembly prior to installation; and

FIG. 7 demonstrates a preformed door assembly of the invention.

DESCRIPTION OF THE PREFERRED EMBODIMENT

The process for forming the laminate of the invention comprises the steps of shaping a solid lamina such as a thin wood veneer to a desired configuration such as a half-round configuration and thereafter adhering the shaped veneer by conventional hot melt gluing techniques to a corrugated lamina which has had a series of lateral grooves placed therein. The corrugated lamina may be a three layer corrugation formed from paper and the lateral grooves thus shown almost totally penetrate the corrugation except for the thin outer surface. The preferred laminate of the invention is formed from a 1/16 inch solid pine veneer which is glued to a triple layer corrugated paper veneer which may be 9/16 inches thick and having lateral grooves formed therein on one (1) inch centers.

The preferred assembly of the invention includes a frame having a laminated segment as hereinbefore discussed and including an inner section which may be for example panes of glass, a hinged door or a plurality of louver members.

DETAILED DESCRIPTION OF THE DRAWINGS

A perspective view of laminate 10 is shown in FIG. 1 having a semielliptical configuration. Laminate 10 is composed of a thin wood veneer 11 such as 1/16 inch pine which is bonded to a three (3) layer corrugated member 12. Veneer lamina 11 is bonded to corrugate lamina 12 by conventional bonding techniques such as with a hot melt glue and as shown in enlarged fashion in FIG. 2 corrugate lamina 12 has three (3) corrugated layers A, B and C. As further shown in FIG. 2 corrugated lamina 12 includes a series of lateral grooves 13 which are deformed and are closed somewhat as they join veneer lamina 11 since laminate 10 is arcuately shaped. Grooves 13 do not penetrate outer most surface 14 of corrugate lamina 12 but do penetrate inner most surface 15 as seen in FIG. 4 as saw 16 forms lateral grooves 13 along corrugated lamina 12. Thus, as formed laminate 10 will provide a durable light weight arcuate configuration useful in upper portion 17 of preformed door assembly 18 as shown in FIG. 7 or in upper portion 19 of window assembly 20 as shown in FIG. 3. Frame 21 of door assembly 18 as seen in FIG. 7 is substantially rectangular in shape and can also be formed from laminate 10 as shown in FIG. 1 as can preformed louver assembly 22 shown in FIG. 6 or window assembly 20 as shown in FIG. 3. As would be understood, preformed louver assembly 22 has a triangular shaped outer frame 23 which contains a plurality of louver members 24. Preformed window assembly 20, louver assembly 22 and door assembly 18 are sized to fit within conventional size "rough" openings in housings or other buildings and are preformed at the factory for delivery to the job site for installation and "trimming" by carpenters or the like. As shown in FIGS. 1, 3, 6 and 7 an assembly can be formed having outer frames of various geometrical configurations such as half-round, elliptical, ovals and other shapes. The then solid lamina, whether it be a pine veneer, hard wood veneer, plastic or other material is relatively easy to bend and shape, and a desired configuration is thus easy to obtain since the relatively thick corrugated lamina 12 as shown in FIG. 1 when bonded to solid lamina 11 maintains the desired shape.

In FIG. 5 a detailed view of half-round window 19 in cross-section is shown in which a double glass pane 30 is used whereby upper casing 31 and lower casing 32 are applied inside the building after the window assembly is properly positioned as is outside upper brick molding 33 and lower brick molding 34. Upper casing 31 is positioned against sheetrock 35 and pane 30 rests against upper edge band 36 and lower edge band 37 which are formed from wood or other suitable materials. As further shown in FIG. 5 corrugated lamina 12 may be approximately three (3) inches wide and have a thickness of approximately 9/16 inch whereas pine lamina 11 as seen in FIG. 5 may also be approximately 3 inches wide but may be only 1/16 inch thick.

In FIG. 4 corrugated member or lamina 12 which may be for example three (3) inches wide and 66½ inches long and 9/16 inches thick may be placed on a conventional saw table 50 and lateral grooves 13 are cut approximately ⅛ inches wide on 1 inch centers. The groove depth may be for example ½ inches leaving only a thin surface 14 which saw blade 16 does not penetrate. A thin pine veneer 11, 1/16 inch thick is cut with other dimensions substantially the same as corrugated lamina 12. Thereafter an adhesive such as hot melt glue 40 can be applied to one side of the wood veneer 11 prior to assembly.

Next, wood veneer 11 is bent to the desired shape such as a half-round with glue 40 being on the outer side and is secured in the half-round configuration by a mold, pattern, braces or the like. Corrugated lamina 12 is then pressed into contact with the outer surface of the arcuately formed wood veneer 11 and by conventional gluing techniques employing heat, high frequency waves or otherwise sturdy laminate 10 is formed. As would be understood the corrugated lamina surface 15 as shown in FIG. 4 is brought into contact with wood veneer 11 whereby the smooth uninterrupted surface 14 of lamina 12 is thereafter the outermost surface. Once glue 40 sets the laminate such as laminate 10 in FIG. 1 thus formed is removed from the mold or brace (not shown) and the arcuate configuration is thus maintained. An inside view of curved laminate 10 demonstrates a wood surface not unlike conventional solid wood members in appearance which have required much greater time consuming sawing and gluing steps.

As hereinbefore mentioned, a door, window or louver assembly can be constructed using laminate 10 as a segment of the frame, such as the upper most portion of a preformed window or door assembly. A frame thus constructed will be lighter in weight than conventional wooden frames yet will have the desired structural integrity, shape and appearance once installed.

Modifications and changes can be made to the invention as described herein by those skilled in the art without departing from the intended scope of the invention and the illustrations and examples presented herein are for illustrative purposes and are not intended to limit the scope of the appended claims.

I claim:

1. A door assembly for installing into a rough wall opening of a building comprising: an outer frame, said frame for positioning against the wall opening, said frame including a laminated segment having a corrugated lamina formed from paper and a solid lamina, said corrugated and solid lamina being bonded together, a door member, and said door member attached to said frame.

2. A window assembly for installing into a rough wall opening of a building comprising: an outer frame, said frame for positioning against the wall opening, said frame including a laminated segment having a corrugated lamina formed from paper and a solid lamina, said corrugated and solid laminae being bonded together, a window member, and said window member attached to said frame.

3. A louver assembly for installing into a rough wall opening of a building comprising: an outer frame, said frame for positioning against the wall opening, said frame including a laminated segment having a corrugated lamina formed from paper and a solid lamina, said corrugated and solid laminae being bonded together, a louver member, and said louver member attached to said frame.

4. An assembly for installing into a rough wall opening as claimed in claim 1 wherein said outer frame is formed from wood.

5. An assembly for installing into a rough wall opening as claimed in claim 2 wherein said outer frame is formed from wood.

6. An assembly for installing into a rough wall opening as claimed in claim 3 wherein said outer frame is formed from wood.

* * * * *